US005115711A

United States Patent [19]

Bushagour et al.

[11] Patent Number: 5,115,711

[45] Date of Patent: May 26, 1992

[54] MISSILE CANISTER AND METHOD OF FABRICATION

[75] Inventors: Abubaker M. Bushagour, Maplewood; James G. Vaske, Mounds View; Stan P. Bovee, St. Cloud, all of

[73] Assignee: FMC Corporation, Chicago, Ill.

[21] Appl. No.: 675,365

[22] Filed: Mar. 25, 1991

[51] Int. Cl.[5] ..... F41F 3/042

[52] U.S. Cl. ..... 89/1.816

[58] Field of Search ..... 89/1.816, 1.817, 1.818; 523/218; 521/54

[56] References Cited

U.S. PATENT DOCUMENTS

| | | | |
|---|---|---|---|
| 2,792,962 | 5/1957 | Granfelt | 89/1.816 |
| 2,844,073 | 7/1958 | Ré et al. | 89/1.817 |
| 3,185,035 | 5/1965 | Gregory-Humphies | 89/1.816 |
| 3,266,373 | 8/1966 | Brown | 89/1.816 |
| 3,319,522 | 5/1967 | Gould et al. | 89/1.816 |
| 3,367,235 | 2/1968 | Andrews | 89/1.816 |
| 3,708,563 | 1/1973 | Sells | 89/1.816 |
| 3,710,678 | 1/1973 | Abelin et al. | 89/1.816 |
| 3,718,070 | 2/1973 | Schneider et al. | 89/1.816 |
| 3,750,529 | 8/1973 | Reed et al. | 89/1.816 |
| 3,754,497 | 8/1973 | Rusbach | 89/1.816 |
| 3,841,197 | 10/1974 | Morrisey | 89/1.816 |
| 3,988,961 | 11/1976 | Banta et al. | 89/1.816 |
| 4,077,922 | 3/1978 | Farrissey et al. | 523/218 |
| 4,079,162 | 3/1978 | Metzger | 523/218 |
| 4,296,669 | 10/1981 | Debana et al. | 89/1.816 |
| 4,336,740 | 6/1982 | Leigh et al. | 89/1.816 |
| 4,470,336 | 9/1984 | Swann et al. | 89/1.816 |
| 4,604,939 | 8/1986 | Hoffmaster et al. | 89/1.816 |

*Primary Examiner*—David H. Brown

*Attorney, Agent, or Firm*—R. C. Kamp; R. B. Megley

[57] ABSTRACT

A missile canister for storing, transporting and launching missiles includes inner and outer skins and a compression resistant honeycomb type material between the skins. An alternative embodiment on the missile canister has an epoxy syntactic foam material between the skins of the cells which are attached one to another by threaded fasteners which cooperate with tapped holes in the cell walls.

17 Claims, 3 Drawing Sheets

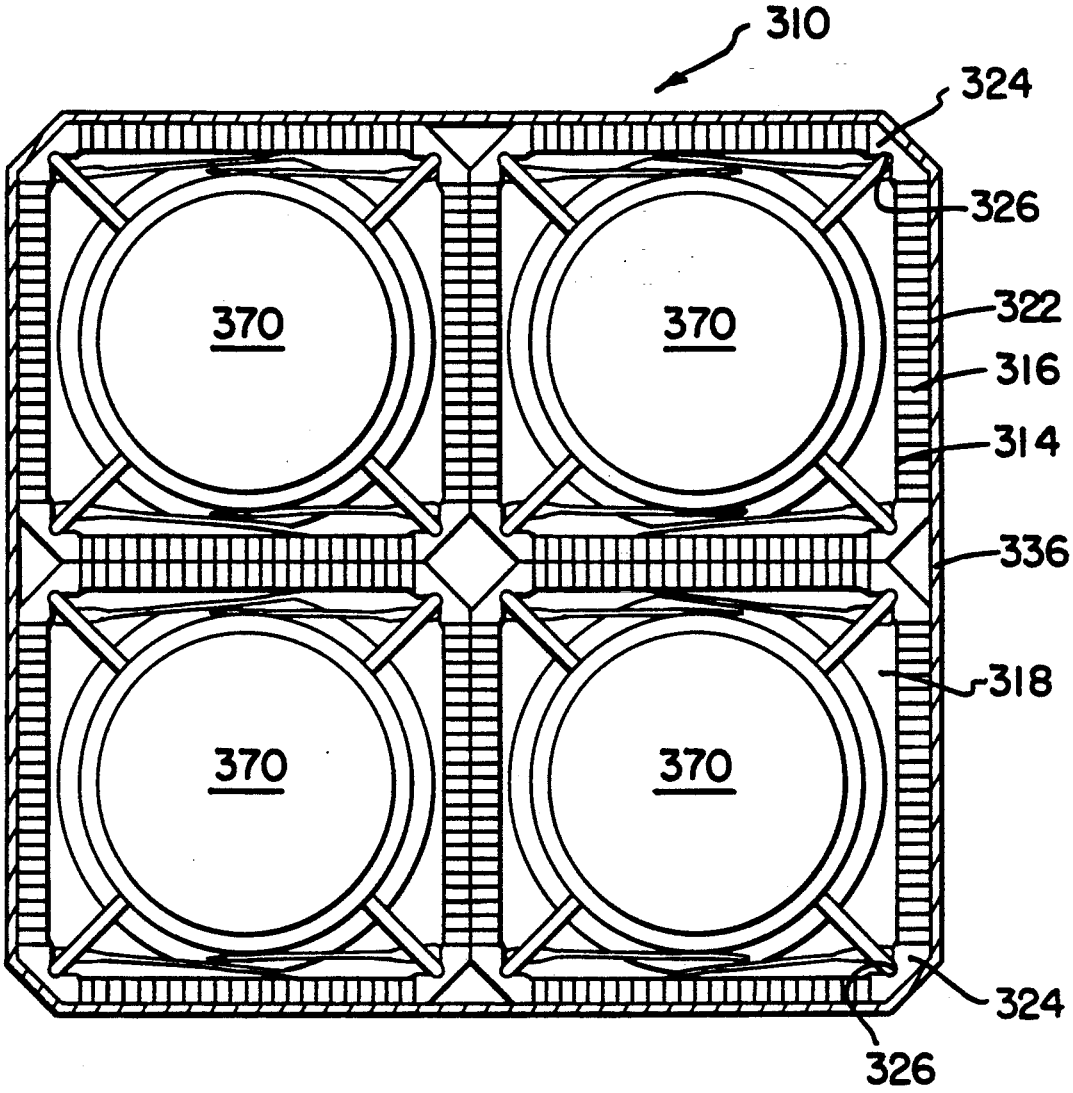
FIG_3
FIG_5
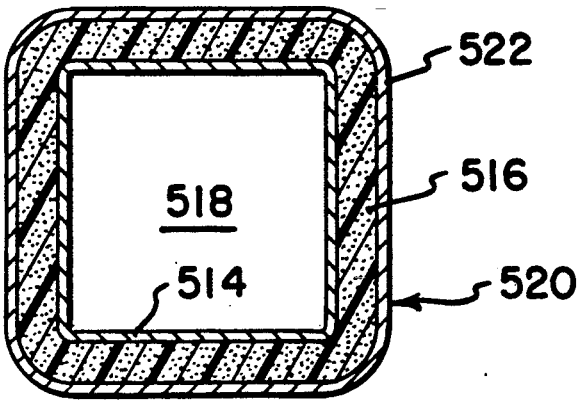

MISSILE CANISTER AND METHOD OF FABRICATION

TECHNICAL FIELD

The present invention relates to missile canisters for storing, transporting and launching missiles. More particularly, the present invention relates to such canisters which are intended for use on naval vessels.

BACKGROUND OF THE INVENTION

Missile canisters of the prior art which have been used in conjunction with shipboard vertical launch systems to store, transport and launch missiles have generally enclosed only a single missile. These prior art canisters are typically constructed of steel and incorporate welded reinforcements and/or corrugations in order to achieve sufficient strength to provide adequate protection for the missile during transport and storage and to withstand the stress of missile firings. Thus, these canisters of the prior art are heavy and occupy a volume much larger than that of the missile they enclose. The size and weight of these canisters of the prior art thus limit the number of missiles which can be placed on a ship of given type and size.

DISCLOSURE OF THE INVENTION

It is an object of the present invention to provide a missile canister which is light in weight.

It is also an object of the present invention to provide a missile canister that is of small size relative to the size of the missile it is to contain.

It is also an object of the present invention to allow a greater number of missiles to be carried on a naval vessel of given type and size than is possible with missile canisters of the prior art.

It is a further object of the present invention to provide a missile canister which can accommodate multiple missiles in a single canister.

It is a further object of the present invention to provide a missile canister which provides sufficient strength to protect a missile contained therein during storage and transport and to provide protection for other missiles and other objects which are proximate to the canister during firing of a missile therein.

In keeping with the above objectives, an embodiment of the present invention includes an outer canister skin of aluminum or other suitable material surrounding a longitudinal canister axis and a plurality of missile cells within the canister skin member each of which has an inner cell skin of aluminum or other suitable material. A compression resistant material, such as aluminum honeycomb or epoxy syntatic foam, fills an interstitial space defined by the canister skin member and cell skin members.

An alternative embodiment of the missile canister of the present invention includes a plurality of missile cells each of which has a cell wall generally surrounding a longitudinal cell axis and releasable fastening means, such as fastener strips which may be bolted to the cell walls, for releasably fastening the missile cells together to form a multiple cell canister. Each of the missile cells of such an embodiment may include an outer missile cell skin formed of a suitable material, such as aluminum, and an inner missile cell skin, formed of a similar material, generally surrounding a common longitudinal axis. The interstitial space between the two skins contains a compression resistant material, such as aluminum honeycomb or epoxy syntatic foam.

A missile canister comprising the present invention may be fabricated by providing an outer skin and a inner skin, positioning the inner skin within the outer skin, such that they bound an interstitial space, and injecting an epoxy syntatic foam into the interstitial space.

These and other features, advantages and objectives of the present invention will be further understood upon consideration of the following detailed description together with the drawings in which:

BRIEF DESCRIPTION OF THE DRAWINGS

FIG. 3 is a cross sectional view of a missile canister comprising a third exemplary embodiment of the present invention, and showing missiles in place in the missile cells.

FIG. 5 is a cross sectional view of a single missile cell of a missile canister comprising a fifth exemplary embodiment of the present invention.

DETAILED DESCRIPTION

Figure 1:
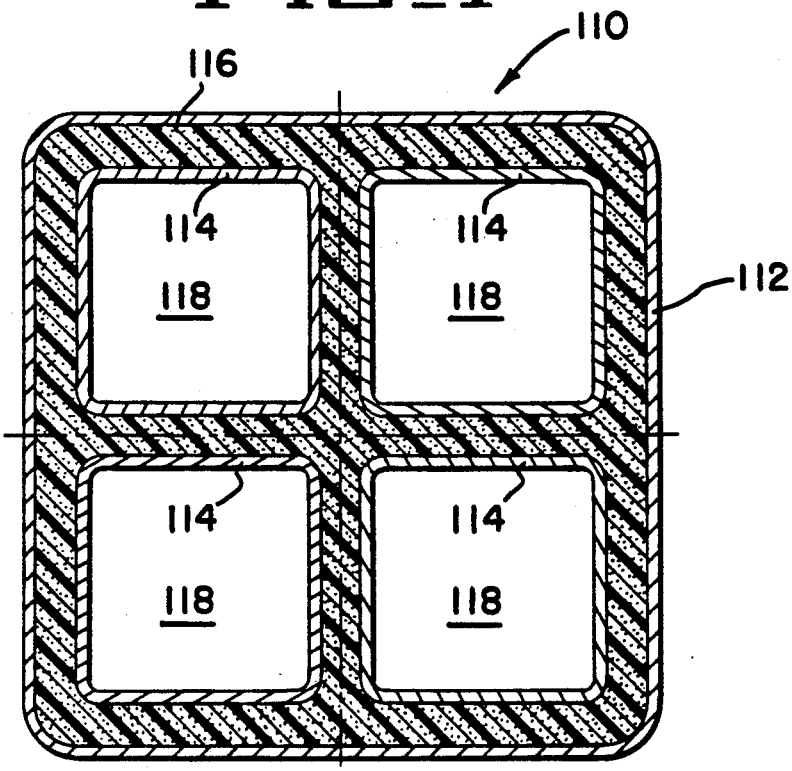
FIG. 1 is a sectional view of a missile canister comprising a first exemplary embodiment of the present invention.

As may be seen in FIG. 1, missile canister 110 comprising an exemplary embodiment of the present invention includes outer canister skin 112 and inner cell skins 114. A compression resistant material 116 fills the interstitial space between the inner cell skins 114 and the outer canister skin 112. In the exemplary embodiment of FIG. 1 inner cell skins 114 and outer canister skin 112 are made of aluminum, but may be made of any material of suitable rigidity and elasticity, for example fiberglass composite. Compression resistant material 116 of exemplary missile canister 110 is an epoxy polymer matrix material comprising glass microspheres in an epoxy polymer matrix. A suitable epoxy syntactic foam may be prepared by mixing, by weight, about 55% epoxy resin, for example Expon 815 as manufactured by Shell Chemical Company, 22% epoxy hardner, for example Jeffamine T403 as manufactured by Texaco Chemical Company, about 5% cure accelerator, for example Accelerator 399 as manufactured by Texaco Chemical Company, and about 17% glass microspheres having a diameter of about 5 microns, for example product B23/500 glass bubbles as manufactured by 3M Corporation.

Exemplary foam core missile canister 110 may be fabricated by first positioning inner cell skins 114 in the desired location within outer skin 112 defining interstitial space 116 in which end caps are then placed at each end of the structure to seal interstitial space 116 from the surrounding atmosphere. Air is withdrawn from interstitial space 116 through a port in one of the end caps by means of a vacuum pump to lower the pressure within the interstitial space to about 5 pounds per square inch below atmospheric pressure. With the longitudinal axis of the missile canister preferably in a near vertical position and the vacuum ported end cap in an elevated position, an epoxy syntactic foam mixed in accordance with the above proportions is then injected into the interstitial space 116 through a port in the lower end cap.

Open honeycomb material, for example an aluminum honeycomb or fiberglass honeycomb material, may be used to assist in maintaining inner missile skins 114 in position within outer canister skin 112 and assure they remain in their desired position during the foam injection process. During the foam injection process, foam will flow into and fill the open interstitial space of the canister structure. Also, it may be advantageous to provide a limited number of foam injection ports in outer canister skin 112 through which foam may be injected to facilitate the foaming process by eliminating the need for some portion of the foam material to flow over the entire length of the missile canister. Typically, inner cell skins 114 may be formed of aluminum sheet 0.08 of an inch thick and interstitial space 116 may be of the order of one-half inch.

Alternative embodiments of the missile canister of the present invention may utilize other compression resistant core materials, for example aluminum honeycomb or balsa wood.

Figure 2:
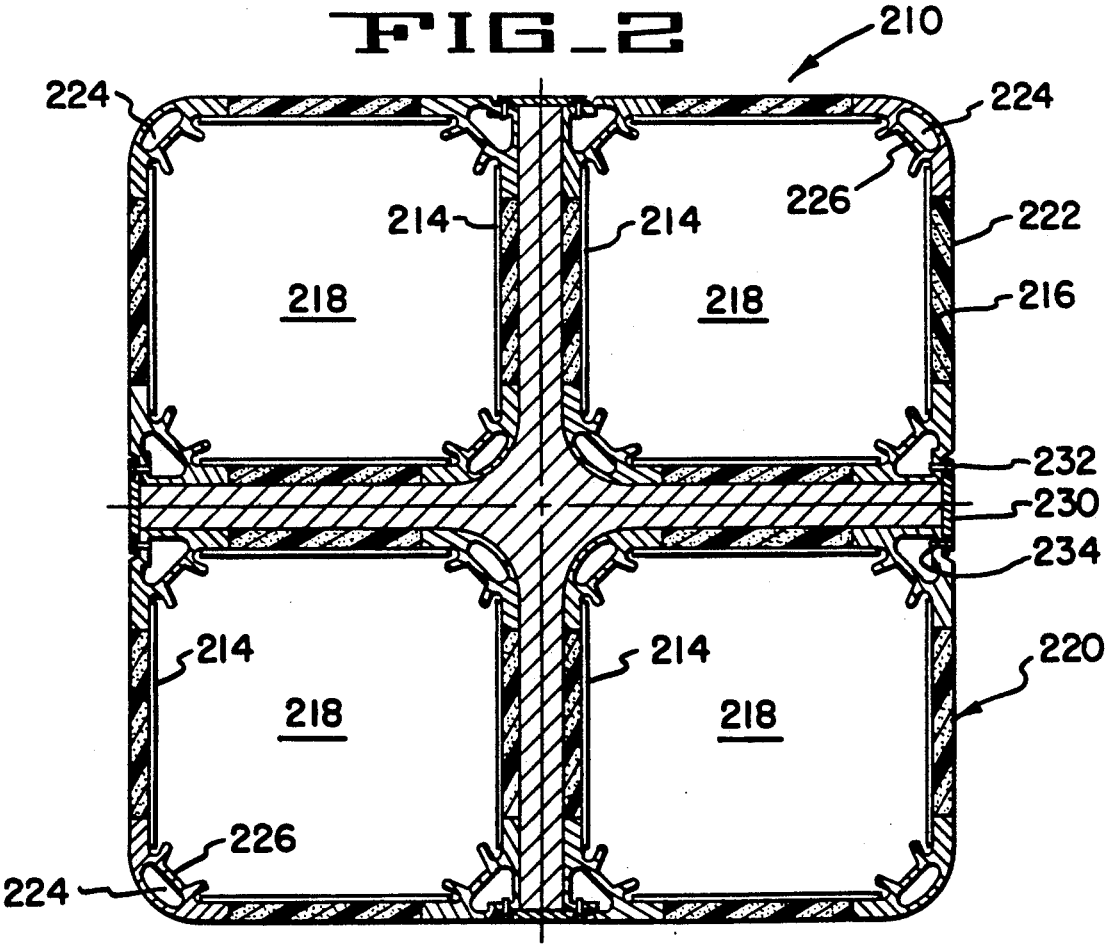
FIG. 2 is a cross sectional view of a missile canister comprising a second exemplary embodiment of the present invention.

Exemplary missile canister 210 of FIG. 2 comprises a second embodiment of the present invention and comprises four missile cells 218. Wall 220 of each of missile cells 218 has an inner missile cell skin 214 and outer missile cell skin 222 which sandwich a honeycomb core 216 in interstitial space. Corner fittings 224 join the plainer cell wall panels of exemplary missile canister 210 and include fin guides 226. Missile cells 218 are joined one to another by means of tie strip 230 and bolts 232 which pass through holes in edge portions of the tie strip and thread into threaded holes 234 in corner fittings 224. This allows any of missile cells 218 to be removed from missile canister 210 and refurbished or replaced by a similar missile cell should the cell become damaged, require refurbishment after a missile firing, or need to be replaced by a missile containing cell after a single missile has been fired from missile canister 210.

FIG. 3 is a cross sectional view of an exemplary missile canister 310 comprising a third embodiment of the present invention with missiles 370 in place within missile cells 318. Corner fittings 324 of missile canister 310 include recessed missile fin guide grooves 326. The interstitial space between inner missile skin 314 and outer missile cell skin 322 is filled with aluminum honeycomb 316. Individual missile cells of missile canister 310 are bound together by binding strap 336 which may be severed to remove individual missile cells 318 from canister 310. Those familiar with the art will recognize that a large variety of well known releasable fasteners may be utilized to join together individual cells 318.

Figure 4:
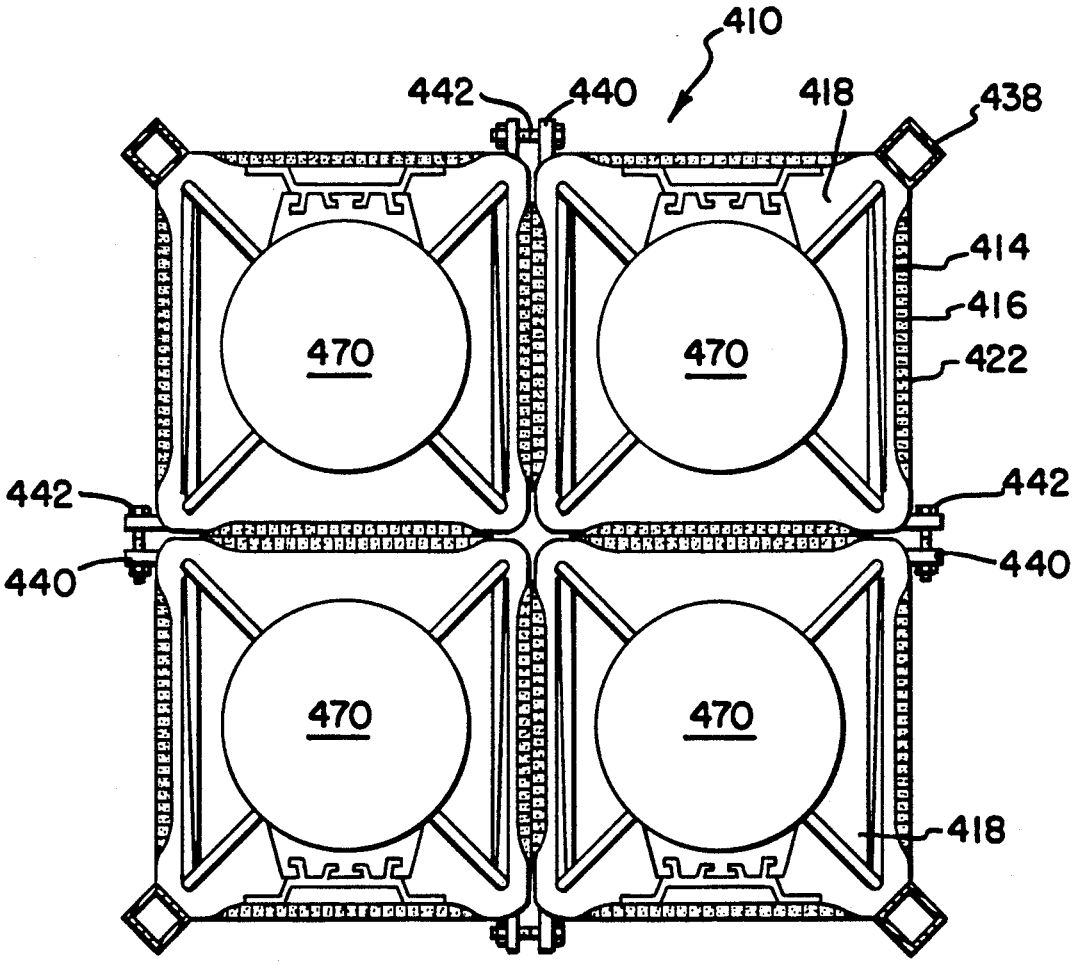
FIG. 4 is a cross sectional view of a missile canister comprising a fourth exemplary embodiment of the present invention.

Missile canister 410 of FIG. 4 comprises a fourth exemplary embodiment of the present invention in which interstitial space 416 between inner missile cell skin 414 and outer missile cell skin 422 is also filled with an aluminum honeycomb material. Missile cells 418 of missile canister 410 are each fabricated from a sheet of aluminum honeycomb core material by first crushing the honeycomb material along lines at which the corners of the cells are to be formed and then bending the sheet to form the corners of a closed cell. Corner stringers 438 are then welded to crushed edges of the panel to form the closed cell. Missile cells 418 of canister 410 are releasably attached by nut and bolt sets 442 which cooperatively engage eyes 440 which are welded to outer missile skin 422.

An individual cell 518 of a missile canister comprising a fifth embodiment of the present invention is shown in the sectional view of FIG. 5. Cell wall 520 of missile cell 518 comprises inner skin 514 and outer skin 522 separated by interstitial space 516 which is filled with an epoxy syntactic foam. Individual missile cells 518 may be fabricated in a manner similar to that described above for the fabrication of integral missile canister 110. Fittings for releasably attaching missile cells 518 one to another may be welded to outer missile cell skin 520 prior to placement of the epoxy foam in interstitial space 516 when outer skin 520 is fabricated of a metallic material. Should outer skin 522 be fabricated of a nonmetallic material, for example a composite fiberglass material, such fittings may be embedded in the fiberglass outer skin during its fabrication.

The epoxy syntactic foam of the preferred embodiments will have a density of about 39 to 41 pounds per square foot. Those familiar with the art will recognize that wiring and tubing for servicing and controlling a missile within missile canisters constructed by an in place foaming process may be installed in the interstitial space 116 before the foam is placed thus embedding such wiring and service lines in the foam for their protection and to provide an unobstructed interior and exterior surface of the missile cells and missile canister.

While exemplary missile canisters comprising embodiments of the present invention have been shown, it will be understood by those knowledgeable in the art that the invention is not limited to those embodiments. Modification may be made by those skilled in the art, particularly in light of the foregoing teachings. For example, a fiberglass honeycomb material may be utilized to fill the interstitial space. It is, therefore, contemplated by the appended claims to cover any such modification which incorporates the essential features of this invention or encompasses the true spirit and scope of the invention.

We claim:

1. A missile canister for storing, transporting and launching missiles comprising:

an outer canister skin surrounding a longitudinal canister axis;

a plurality of missile cells within said canister skin, each of said missile cells having a longitudinal cell axis generally parallel to said canister axis and a cell skin surrounding said cell axis, said canister skin and said cell skins together defining an interstitial space; and, a compression resistant material, including honeycomb type material, within said interstitial space.

2. A missile cell for storing, transporting and launching a missile comprising:

an outer missile cell skin surrounding a longitudinal missle cell axis;

an inner missile cell skin surrounding said longitudinal missle cell axis such that an interstitial space is defined between said inner and outer missile cell skins; and a compression resistant material including a honeycomb type material within said interstitial space.

3. A missile cannister for storing, transporting and launching missiles comprising:

a plurality of missile cells, each missile cell having a cell wall generally surrounding a longitudinal missile cell axis;

releasable attachment for releasably fastening said cells together including means for releasably attaching one of said cells in fixed relation to another one of said cells;

each of said cell walls including an outer missile cell skin surrounding said londitudinal missile cell axis and an inner missile cell skin surrounding said longitudinal cell axis, such that an interstitial space is defined between said inner missile cell skin and said outer missle cell skin, and a compression resistant material including a honeycomb type material within said interstitial space.

4. A missile canister as in claim 3 in which said releasable attachment means comprises:

a tie strip having a longitudinal axis lying generally between a first and a second edge portion;

first means for releasably connecting said first edge portion to the wall of a first cell; and, second means for releasably connecting said second edge portion to the wall of a second cell.

5. A missile canister as in claim 3, in which said compression resistant material includes a foam material.

6. A missle cell as in claim 5 in which said foam has a density of about 40 pcf.

7. A missile cell as in claim 5, in which said foam is an epoxy syntactic comprising glass microspheres within an epoxy polymer matrix.

8. A missile cell as in claim 7 in which said microspheres are of a diameter of about five microns.

9. A missile cell as in claim 8, in which said epoxy syntactic foam is formed by mixing about 55 percent epoxy resin, 22 percent epoxy hardener, 5 percent cure accelerator and 17 percent glass microspheres by weight.

10. A missile cannister for storing, transporting and launching missiles comprising:

a plurality of missile cells, each missile cell having a cell wall generally surrounding a longitudinal missle cell axis;

releasable fastening means for releasably fastening said cells together;

each of said cell walls including an outer missile cell skin surrounding said longitudinal missile cell axis and an inner missle cell skin surrounding said longitudinal cell axis, such that an interstitial space is defined between said inner missile cell skin and said outer missile cell skin, and a compression resistant material including a honeycomb type material within said interstitial space.

11. A missile cannister for storing, transporting and launching missiles comprising:

a plurality of missile cells, each missile cell having a cell wall generally surrounding a longitudinal missile cell axis;

releasable fastening means for releasably fastening said cells together;

each of said cell walls including an outer missile cell skin surrounding said longitudinal missile cell axis and an inner missile cell skin surrounding said longitudinal cell axis, such that an interstitial space is defined between said inner missile cell skin and said outer missile cell skin, and a compression resistant material within said interstitial space;

said releasable fastening means comprising:

a tie strip having a longitudinal axis lying generally between a first and a second edge portion;

first means for releasably connecting said first edge portion to the wall of a first cell;

second means for releasably connecting said edge portion to the wall of a second cell;

said first and second releasable connecting means each including threaded fasteners adapted to cooperate with threaded holes formed in said first and second cell walls.

12. A missile cannister as in claim 11 in which said cell axes are generally parallel to one another and said cells have a generally square cross section.

13. A missile canister as in claim 12 in which each of said cells comprises a longitudinal corner fitting at a corner of the cell and said threaded holes are formed in said corner fitting.

14. A missile canister as in claim 13 in which said compression resistant material includes a honeycomb type material.

15. A missle cell as in claim 14 in which said compression resistant material includes a foam material.

16. A missile cell as in claim 15 in which said foam is an epoxy syntactic foam comprising glass microspheres within an epoxy polymer matrix.

17. A missile cell as in claim 16 in which said epoxy syntactic foam is formed by mixing about 55 percent epoxy resin, 22 percent epoxy hardener, 5 percent cure accelerator and 17 percent glass microspheres by weight.

* * * * *